US006893021B1

(12) United States Patent
Gress

(10) Patent No.: US 6,893,021 B1
(45) Date of Patent: May 17, 2005

(54) WRESTLING CARD GAME

(76) Inventor: Edmund A. Gress, 1 Linden St., Unit C-6, Norwalk, CT (US) 06851

( * ) Notice: Subject to any disclaimer, the term of this patent is extended or adjusted under 35 U.S.C. 154(b) by 0 days.

(21) Appl. No.: 09/693,145

(22) Filed: Oct. 20, 2000

Related U.S. Application Data

(60) Provisional application No. 60/208,532, filed on Jun. 1, 2000.

(51) Int. Cl.[7] ..... A63F 1/00; A63F 9/20; A63F 1/02

(52) U.S. Cl. ..... 273/298; 273/292

(58) Field of Search ..... 273/298, 308

(56) References Cited

U.S. PATENT DOCUMENTS 4,861,031 A 8/1989 Simms
5,071,136 A * 12/1991 Lott ..... 273/259
5,163,688 A 11/1992 Simms
5,201,525 A * 4/1993 Castro ..... 273/293
5,221,091 A * 6/1993 Gallegos et al. ..... 273/247
5,467,997 A * 11/1995 Bashirzadeh ..... 273/302
5,662,332 A * 9/1997 Garfield ..... 273/308
5,951,013 A * 9/1999 Campanella ..... 273/308

OTHER PUBLICATIONS

"Nitro Trading Card Game" advertisement, Copyright 2000 Wizards of the Coast, Inc.—5 pages.

* cited by examiner

*Primary Examiner*—Gregory Vidovich
*Assistant Examiner*—Alvin A. Hunter, Jr.
(74) *Attorney, Agent, or Firm*—Ohlandt, Greeley, Ruggiero & Perle

(57) ABSTRACT

A card game uses game cards having various indicia thereon used to simulate a wrestling match. The indicia can be statistics and rankings of the wrestlers which are compared by the players during the course of the game. The indicia can also be POP or Points of Pain for each wrestler and the moves or maneuvers of each wrestler which are used during the course of the game. The game cards can also have an image of wrestlers thereon.

14 Claims, 3 Drawing Sheets

WRESTLING CARD GAME

CROSS REFERENCE TO RELATED APPLICATION

This application claims the benefit of U.S. Provisional Application Ser. No. 60/208,532 filed on Jun. 1, 2000.

BACKGROUND OF THE INVENTION

1. Technical Field

The present invention relates generally to card games and methods of playing the same. More particularly, it relates to a card game related to the sport of wrestling and a method of playing the same.

2. Description of the Background Art

There have been a number of card games developed for simulating various sporting events including wrestling matches. Two patents which depict simulated wrestling matches are U.S. Pat. Nos. 4,861,031 and 5,163,688, both by inventor Cosmian E. Simms. These patents describe cards with images of various wrestling maneuvers thereon. The players determine the sequence to display their cards in order to gain a strategic advantage during play. While the games described in U.S. Pat. Nos. 4,861,031 and 5,163,688 do simulate wrestling matches, they do not take advantage of the burgeoning popularity of professional wrestling today as they do not use any of the images or statistics of actual wrestlers.

SUMMARY OF THE INVENTION

It is an object of the present invention to provide a novel apparatus and method for playing card games simulating wrestling matches which overcome the drawbacks of the prior art games.

It is also an object to provide such an apparatus and method in which playing cards having information thereon which is compared to determine the winner of the games.

Still another object is to provide such an apparatus and method in which the information on the playing cards includes rankings, statistics, a total amount of punishment rating and wrestling move punishment ratings for the depicted wrestlers.

A further object is to provide such an apparatus and method which may be easily used by persons of all ages.

It has now been found that the foregoing and related objects can be readily attained in an apparatus for playing various competitive card games simulating wrestling matches which includes a plurality of playing cards with each card representing a specific wrestler and having indicia thereon representing various information about the wrestler. The information on the cards is used and compared during the playing of the competitive card games to determine a winner of the card games.

Desirably, the information on each card includes an image of a specific wrestler thereon. The information on each card could also include (1) a ranking of the specific wrestler represented thereon; (2) a rating of total amount of punishment that the specific wrestler represented thereon can sustain; (3) a rating of punishment of each move that the specific wrestler represented thereon can inflict on an opponent; and (4) statistics of the specific wrestler. The statistics are chosen from a group consisting of height, weight, number of titles, bicep/tricep size, chest size and crowd appeal.

In using the apparatus to perform the method for playing various competitive card games simulating wrestling matches, the plurality of playing cards are separated into a number of stacks corresponding to players playing the game and a card from the stack of each player is selected and information on the selected cards are compared to determine a winner of the card game.

In one embodiment of the method, the rankings of the wrestlers represented on the selected cards are compared and the player with the card having the lowest ranking wins the cards of the other player(s).

In another embodiment of the method, the comparing step includes each player sequentially selecting wrestling moves to be performed from the selected card of the player and subtracting the ratings of punishment of the selected wrestling moves from the ratings of total amount of punishment of the selected card of the other player until one of the players depletes the total amount of punishment of the other player.

In yet another embodiment of the method, during the comparison step, at least one of the statistics of the wrestlers represented on the selected cards are compared and the player with the card having the highest statistic wins the cards of the other player(s).

The invention will be fully understood when reference is made to the following detailed description taken in conjunction with the accompanying drawings.

DETAILED DESCRIPTION OF THE INVENTION

Figure 1:
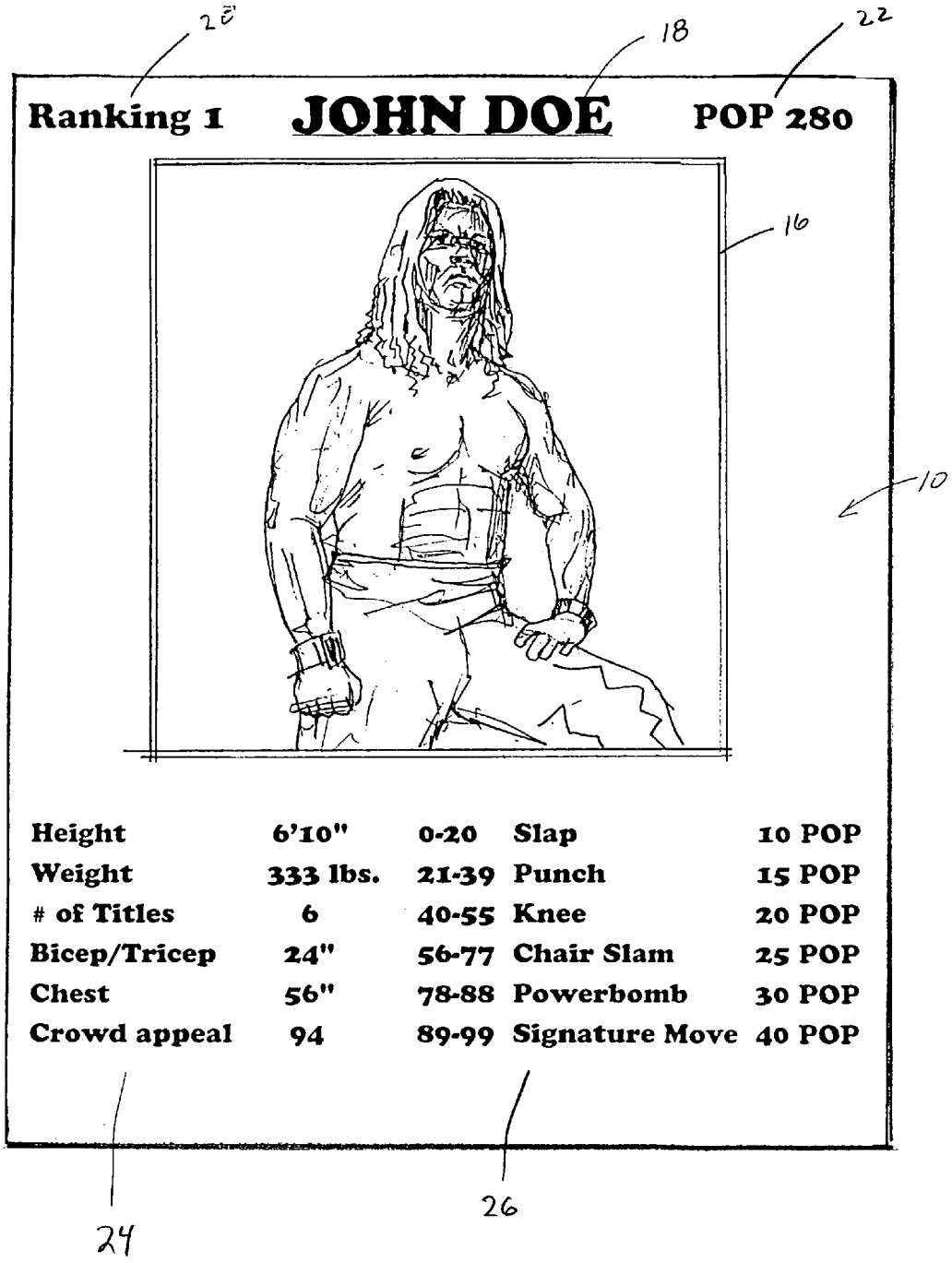
FIGS. 1–3 are bottom views of various playing cards of the present invention showing the face sides thereof.
Figure 2:
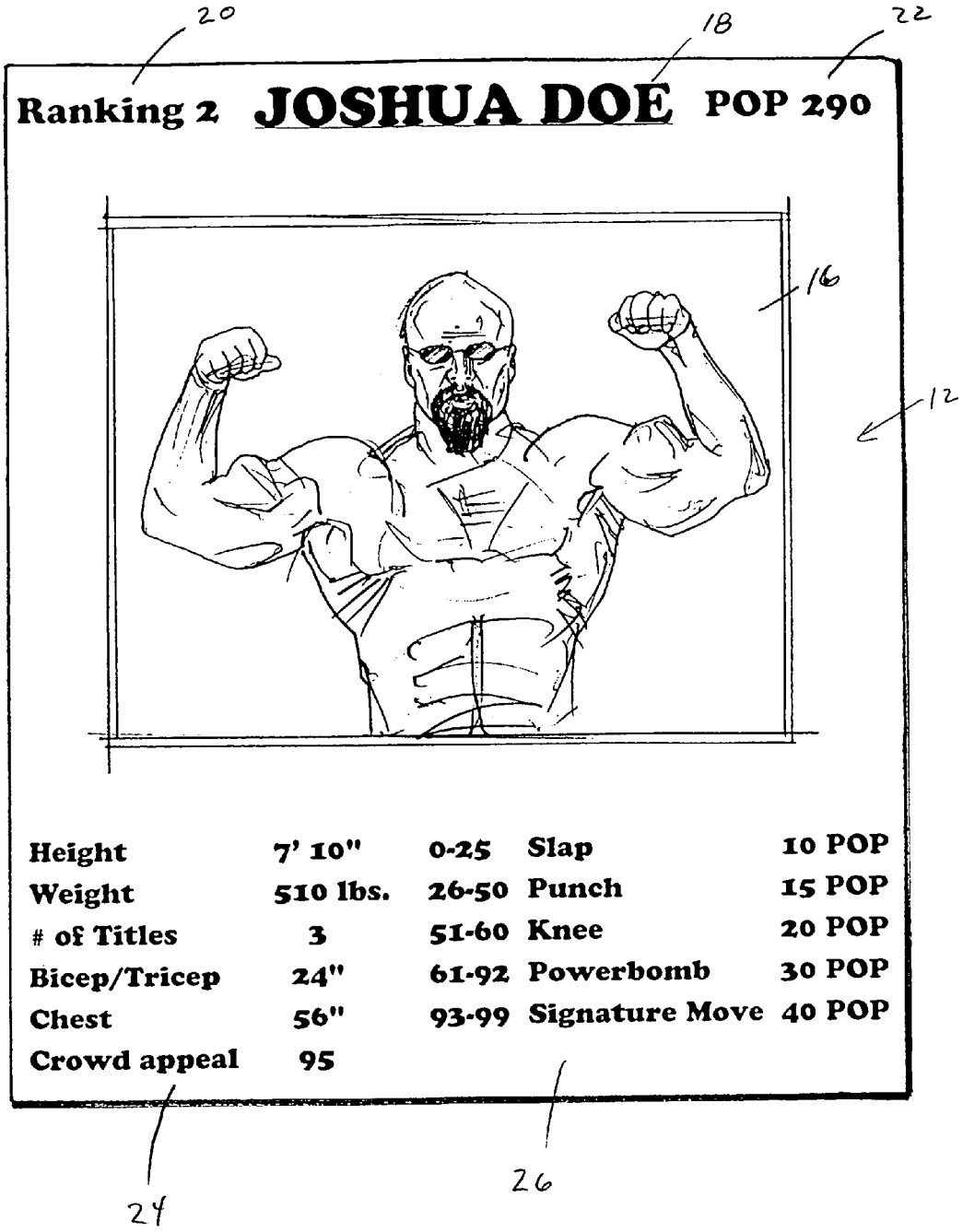
Figure 3:
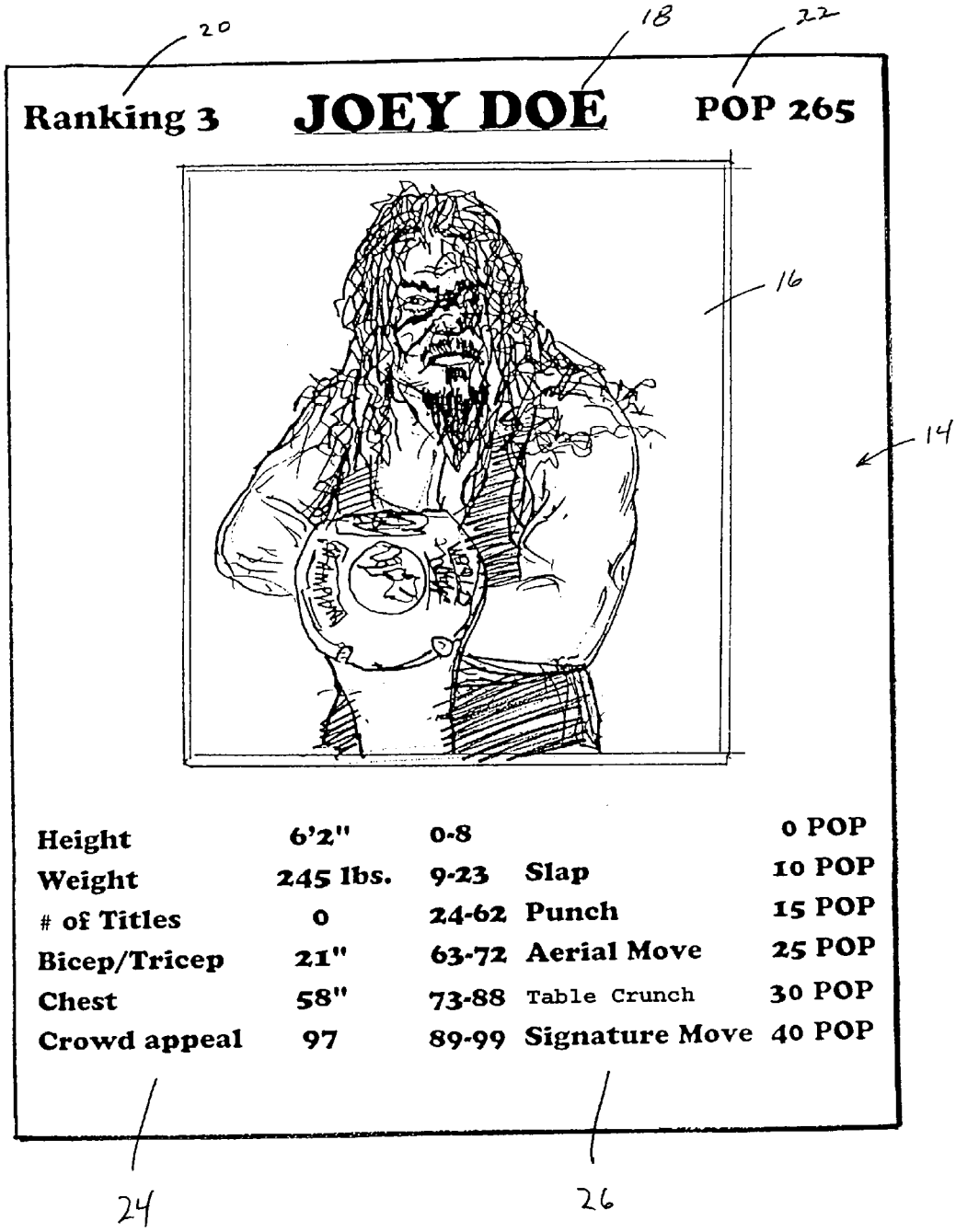

With particular reference to FIGS. 1–3, three different exemplary cards made in accordance with the present invention are illustrated and generally designated by the numerals 10, 12 and 14, respectively. Each of the cards 10, 12 and 14 has an image 16 of a respective wrestler thereon. The wrestler's image 16 could be a photograph or a drawing as desired.

The cards 10, 12 and 14 have various indicia thereon used in playing card games simulating a wrestling match. Centered directly above the wrestler's image 16 on each card is the name 18 of the wrestler. On these cards 10, 12 and 14, the wrestlers are named John Doe, Joshua Doe and Joey Doe, respectively. To the left of the wrestler's name 18 is the wrestler's ranking 20 and to the right of the name is the wrestler's POP 22 or "Points of Pain" which represents the wrestler's overall ability to accept pain from punishment from his opponent. Below the wrestler's image 16 on the left side of each card 10, 12 and 14 is a chart 24 of statistics about the wrestler. These statistics can include height, weight, number of titles, bicep/tricep measurement, chest size and crowd appeal. On the right side of each of the cards below the wrestler's image 16 is a chart 26 of different wrestling moves or maneuvers the wrestler can employ during the course of a wrestling match and the amount of POP or "Points of Pain" each move will inflict on his opponent. The purpose and meaning of the various indicia on the cards 10, 12 and 14 will become clear upon further explanation of the method of use of the cards 10, 12 and 14 as provide hereinafter. It should be noted that the wrestler's ranking, total "Points of Pain", crowd appeal and "Points of Pain" for moves are assigned to each depicted wrestler arbitrarily by the manufacturer of the card. The remaining statistics on each of the wrestlers could also be arbitrarily created by the manufacturer if the wrestlers are fictional but also can be based on the statistics of actual wrestlers.

Having described the cards 10, 12 and 14, the use of the cards 10, 12 and 14 will now be explained. Although only three cards are shown in the drawings, it should be understood that a plurality of such cards could be made to produce a set of cards. Each card in a set of cards used in any one of the following games would depict a different wrestler.

For the following four games described, the object is to defeat your opponent(s) and gain his/their card(s). Each player supplies his own cards to be used in play.

Wrestler's Statistical Series:

One method of using the cards is the Wrestler's Statistical Series in which the object of the game is to gain the opponent's cards by picking a statistical category in which your wrestler has an advantage over the opponent's wrestler and, after comparison, to win his card. For Wrestler's Statistical Series, each player will hold their cards with the statistics of his wrestler facing him, and in such a manner so that at the same time the player's opponent(s) cannot see his card's statistics. Listed in the chart 24 of each of the cards are statistics about the wrestler who appears on the card. These statistics include height, weight, number of titles, bicep/tricep measurement, chest measurement, and a rating of the wrestler's crowd appeal. The match begins by choosing one player (e.g. Player A) to play first by a fair method such as flipping a coin, or highest roll of a die. Both players look at the top card in their own stack of cards but do not reveal the card to their opponent. Player A then orally chooses a category from the statistic chart 24 on his top card in which he believes his wrestler has an advantage. The players then call out the statistic on their top cards from the chosen statistical category and determine the winner of the round based on the higher statistic. The winner retains both cards. For example, if Player A's top card was card 10 (i.e. John Doe), he might choose Height as his category as John Doe's height is six feet, ten inches (6' 10"). If Player B then had card 14, (i.e. Joey Doe), who is only six foot, two inches (6' 2"), then Player A would win the round and both cards. If, however, Player B had card 12 which is the seven foot, two inches (7' 2") Joshua Doe, then Player B would win the round and both cards. If a tie occurs, then Player B calls out "Reversal" and chooses a different category from his same card to be compared against Player A's same card. The winner of the 'reversal' comparison wins the round and both cards. If both players tie in all categories, which would occur if both players' card happens to be the same wrestler, then both players need to agree to put their cards back in their stacks in a random place, or to leave those cards to be won by the next round's winner. In this case, the caller of the next round is the caller of the original round. The won cards are then placed to the side of the winner to be used again if both players chose to keep playing after all the cards in their original stacks have been used.

The winner of the round continues the game by choosing a category from the next card in his stack. Play continues until all the cards in the stack are played and the player with the most cards wins the game, or until one player has won all the cards, or until all the players agree to stop playing. It should be noted that, if desired, before play starts, players can be allowed to position their cards in their stack to achieve a maximum advantage, and that the players do not have to start with the same number of cards.

If three or more people choose to play, then all the rules remain the same except in the case of ties. In the case of a tie, only those players whose cards are tied continue, the loser(s) forfeit their card(s), and those cards become part of the eventual winner's purse. Also note that the tie must be the best statistic, if not the tie does not matter. The cards are won by the player with the best statistic. Such as, two players have card 10 (i.e. John Doe), and one player has card 12 (i.e. Joshua Doe), and the category being called is Height. The player with card 12 wins the round and all the cards played in that round. The tie of the lower height statistic of card 10 does not matter. In three or more people play, the order goes in a clockwise direction from the player who has won the original category statistical to call. The first player involved in the tie, (the first player to the left involved in the tie) is the player to call "Reversal" and chose the new category. Then play continues as usual.

Flip-Off:

Another method of using the cards is Flip-Off which can be played between two or more players. If two players are playing, each of the players begins with as many cards as he wishes to play face up in his stack so that both players know which card is being played by both players in each round. A match begins with two players standing opposite and facing each other, each holding one of his cards by the edge(s). The players then release their cards by allowing their cards to tumble end-over-end to the floor. The winner of the round is the player whose card lands face up. If both cards land face up, the wrestler's ranking determines the winner. The higher ranking (i.e. the lower number) wins the round and both cards. The wrestler's ranking is found in the upper left hand corner of each card. For example, if Player A's card was card 12 (i.e. Joshua Doe) who has Ranking 2 and Player B then had card 14 (i.e. Joey Doe) who has Ranking 3, then Player A would win the round and both cards. If, however, Player B had card 10 (i.e. John Doe) with Ranking 1, then Player B would win the round and both cards. In some instances, the players might be using the card of the same wrestler, so the players must be watchful of which cards are theirs during Flip-Off. If both cards land face up and have the same Ranking, then the players can either leave those cards in the "ring" for the winner of the next round, or they can reflip the original cards that were involved in the tie. If both cards land face down, the players can either flip again or leave those cards for the winner of the next round. The methods of play should be determined before play begins. Play continues until all the cards from the original stacks have been used, or until one player wins all the cards, or until the players agree to cease play. The duration of play should be agreed upon before play begins.

When three or more players want to compete, there are several variations of play. In the first variation, each player whose card lands face down loses and forfeits his card. If only one player's card lands face up, he wins all of the cards. Otherwise, the players whose cards have landed face up reflip their cards. This process continues to eliminate players until there is only one player left. That player is the winner of the round and all the cards played in that round. In the second variation, the winner is the player whose card does not match the other players. So, if there are three players and upon flipping their cards, two cards are face down and one card is face up, the player with the face up card wins the round and all the cards played in that round. Likewise, if two cards are face up and one card is face down, the face down card wins the round and all the cards played in that round. If all the players cards land face down in the original round, the players can either reflip the same cards, or leave those cards in the "ring" for the winner of the next round. The winner of that new round wins all the cards that are at stake. If all the cards land face up, then the players can either reflip or use the Ranking to determine the winner of the round. The method of play should be determined before play begins. If the Ranking method is used the player with the highest ranking or lowest number wins the round and all the cards played in that round. If a tie exists for the highest ranking, then only those players who have tied either reflip the same cards or flip new cards. The winner is to be determined by reverting back to the original methods of play. For example if two players are left after the tie, then the card that lands face up is the winner of the round and all the cards. If both land face up then reflip or use rankings, etc. Again, the method of play should be determined before any play begins. Should a player run out of cards during a round, he may borrow cards from any other player or person who has a card and is willing to lend him a card. The player loaning the card(s) must be repaid should the player he is backing wins. That repayment must be the card(s) the loaner gave the borrower as well as a one card interest payment. The repayment is to be chosen by the loaner. If the player who borrows the card(s) loses, then the player who lent him the cards also loses. If no cards are lent to the cardless player, then all cards for that round are returned to their original owners. Also the card lent to the cardless player cannot be known by anyone. It must be picked at random from the loaner's hand who has his cards face down. Play is over when all the players agree to end the game, or one player runs out of cards, or one player wins all the cards. The method for duration of play should be determined before play begins.

In four or more player variation, teams having an equal number of players on each team may be chosen. Whichever team has all of their cards land in the same direction (face up/face down), while their opponents' cards do not—wins the round and all the cards in that round. If there is not a winner, the cards can either be reflipped or left in the ring to be won or lost in the next round.

One last variation that can be used no matter how many players are involved in play is to start with an equal number of cards in each player's stack. The won cards are to be placed aside into a winner's pile next to the winner of the round. When the player's stacks have been exhausted, the player with the most cards in his winner's pile wins all the cards from all the winner's piles.

Wrestler's Duel:

Another method of use for the cards is called Wrestler's Duel. When play is between two players, each player should start with the same number of cards in their stacks, but this is not a necessity. The player places his stack face down in front of him so that no one can see the face of his cards, including the player himself. The cards can be initially arranged by the players, but cannot be rearranged once play has started. In this game, the players flip over their cards one-at-a-time from the top of their personal stacks revealing the ranking of their wrestler. The wrestler's ranking is found in the upper left hand corner of each card. The player with the card-depicting the wrestler having the highest ranking (i.e. meaning lowest number) wins and captures his opponent's card. In the case of a tie, the players can either take back their cards and return them into their original, personal stacks in a random place or leave them in the ring to be won or lost in the next round. The game can end in these ways: 1) as cards are won, they are put in a pile next to the winner. After the original, personal stacks have been used, the player with the most cards in his winner's pile wins all the cards in both winner's piles. In the event that both winner's piles have the same number of cards, the players can either each choose one card at random and have a duel for all the cards by comparing the rankings on the chosen cards. Or the players can keep the cards in their winner's pile. 2) The players can continue to play from the winner's pile after their original, personal stacks have been exhausted. 3) or they can continue until one player wins all the cards. 4) or they can cease after a certain agreed upon period of time. 5) Or until both players agree to end the game. Again, the desired ending of play should be agreed to before play begins.

In a Tag Team variation of the previously explained two player version, if there is a tie, the original cards are left in the ring, then one more card is put into the ring face down by each player, and then a third card is flipped face up by each player. The rankings on the third cards are compared, determining the "King of the Ring" or the winner of all the cards in the ring. If another tie occurs, the procedure is repeated until a winner is determined. If a player runs out of cards during the play of a tie, the cards in the ring are returned to their original owners.

For three or more players single or Tag Team play can be used, the play is the same as with two players being that the player with the highest ranking (i.e. lowest number) wrestler wins and takes the cards played by the other players. In case of a tie, only the players involved in the tie and with the highest ranking continue to flip additional cards to win all the cards in that round.

Wrestler's Match:

Another method of using the cards is known as the Wrestler's Match. It can be played by two or more players. Each player plays with one card at-a-time in single match play, and two cards per match in "tag team" play. The players may predetermine how many matches will be played overall before actual play begins and therefore chose the appropriate number of cards to use for playing the game. The cards are not initially revealed to the other players. In addition to the cards, each player gets a pair of ten-sided dice, one black die and one yellow die with the numbers of 0 through 9 thereon. A scoring pad and a writing instrument, or a calculator, can also be used to record the score of each round as the match progresses.

Each player chooses the card he wishes to use from his personal stack that is to be played in the round, or two cards in Tag Team play. The cards are chosen without revealing them to the other player(s). When the match begins, each player throws the card(s) he has chosen into the ring simultaneously. It is only at the time do both players know their opponent's card(s). On the face of each card in the upper right hand corner, next to the wrestler's name, is each wrestler's "Points of Pain" or "POP" rating. These ratings are arbitrarily assigned but portray the wrestler's overall ability to accept pain from the punishment he will receive from his opponent's successful attacks. In other words, it is the total amount of pain that the wrestler can absorb from his opponent before he loses the match. When a wrestler's 'pop' rating reaches zero or less (a negative number is arrived at after deducting the 'pop' of the attacking wrestler from the total pop rating of the attacked wrestler), the wrestler is subdued, pinned, and defeated. The wrestler with a zero or less rating does not get a counter attack. The match is over and the other player wins the match and all the cards used in the match. In the lower right hand corner of each card is a chart of different moves the wrestler can employ on his opponent. The moves represent the type of maneuvers that wrestler can perform in the ring to defeat his opponent. The move the wrestler employs also correlates to the amount of pain that move will from the wrestler using it will inflict on any opponent. The moves run from the typical slaps, punches, or kneeings to the exotic aerials, piledrivers, powerbombs, chair slams, table crunches, as well as each wrestler's signature move. All of these moves are well known to those skilled in the art. All of the wrestlers moves fall within the same range of 0–99, although each wrestler has different moves and ranges within the overall range of 0–99. Again, the different moves and ranges represent the strengths and weaknesses of the wrestler.

To choose the player that will begin play, each player will throw one die and the player with the highest number begins play. Before play begins, each player must designate which of his die will represent the first number of all his throws and which die will represent the second. The game is played by alternating throws of the dice between players. Each throw of the dice indicates a number between 0 and 99 which corresponds to a wrestling move that the player's wrestler makes on his opponent. The corresponding number of 'pop' from the chart on the player's card is then subtracted from the opponent's total "POP". The first player who depletes the wrestler's total 'pop' of his opponent is the winner. For example, assume Player A's card was card 10 (i.e. John Doe) and Player B had card 12 (i.e. Joshua Doe). Player A on his first roll of the dice rolls a 60. Thus, the equivalent wrestling move to a 60 roll for John Doe is the 'Chair Slam' with a "POP" rating 25 as read off the "POP" chart 26 on card 10. On the score pad, the POP rating of 25 is subtracted from Joshua Doe's total POP rating of 290, leaving him with 265 POPs left. The players would then alternate rolling their dice until the total number of 'POP' ratings from the moves based on the rolls of Player A meets or exceeds Joshua Doe's total POP rating of 290, or the total of the POP ratings of the moves based on Player B's meets or exceeds John Doe's total POP rating of 280. The player who first meets or exceeds his opponent's total POP rating wins the match and the cards.

A variation of play could be if a player rolls doubles (i.e. both dice have the same number), then that player gets another roll. If doubles is achieved a second time in a row, the POP rating for the move is doubled and deducted from the total POP of the opponent.

In Tag Team play, play is conducted as in singles play, but instead two cards of each player are laid face up in the ring for play. Each player chooses the card which is going to be played first before seeing his opponent's cards. To bring the other card into play (i.e. "tag" the wrestling partner), The player forfeits his roll at the time of the tag. A player can "tag" as often as desired. A variation on Tag Team play is, after a roll is forfeited to bring the other card into play, 20 POP (or any number agreed upon between players before play begins) are added to the total POP of the wrestler leaving the ring to represent the "rest" he received while not wrestling. The match is over in one of two ways which the players involved in the match must agree upon before match play begins. Method one is when one of wrestlers of the team has a total POP rating of zero or less. He is considered 'pinned' and the match is over. The other player (who does not have any of his wrestlers having a total POP rating of zero or less) wins the match and all the cards. Method two is a wrestler is considered 'knocked out' when his total POP rating is zero or less. He does not regain any POP and never returns to play in that match. However, the second wrestler of the 'tag team' is still in play. It is only when both wrestlers of one team have a total POP rating of zero or less that the match is over and the winner is determined. The winner wins the match and all the cards used within that match. Total POP can never be traded or moved from one wrestler to the other wrestler of the 'tag team'.

If three or more people are playing the rules remain the same. Order of play is determined by the original roll of one die. The order will proceed from highest roll to lowest roll. In the event of a tie on the rolling for order of play, then the players who tied have a roll off to determine the order of those players. For example, there are four players who have rolled for order of play. Player A rolled a 9, Player B rolled a 2, Player C rolled a 4, and Player D rolled a 4. In the roll-off, Player C rolled a 1 and Player D roll a 9. The order of play would be Player A, then Player D, then Player C, then Player B. Player A and Player D are not considered to be tied for order of play because the order had been determined by the original roll. Likewise, Player C is still before Player B because of the original roll for order of play.

Thus, it can be seen from the foregoing specification and attached drawings that the card game and method of playing the same of the present invention provides an interesting and exciting means for simulating a wrestling match.

It is believed that the many advantages of this invention will be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

Having thus described the invention, what is claimed is:

1. A method for playing a competitive card game simulating wrestling matches, the method comprising the steps of:

(a) providing a stack of playing cards for each-player playing the game, each card representing a specific wrestler and having a plurality of games thereon, wherein said card has indicia thereon representing various information about the wrestler, wherein said indicia has statistics of the specific wrestler;

(b) selecting a statistical comparison game from said plurality of games on said card, said plurality of games comprising a statistical comparison game and a wrestler's match game;

(c) selecting a card from the stack of each player;

(d) choosing one category of the statistics to be compared; and (e) comparing the statistics of the wrestlers on the chosen category on the selected cards to determine a winner of the card game.

2. A method for playing a competitive card game simulating wrestling matches in accordance with claim 1, wherein the categories are chosen from the group consisting of height, weight, number of titles, bicep/tricep size, chest size, crowd appeal, and any combinations thereof.

3. A method for playing a competitive card game simulating wrestling matches in accordance with claim 2, wherein during the comparison step, at least one of the statistics of the wrestlers represented on the selected cards are compared and the player with the card having the highest statistic wins the cards of the other players.

4. A method for playing a competitive card game simulating wrestling matches in accordance with claim 1, wherein during the comparison step, at least one of the statistics of the wrestlers represented on the selected cards are compared and the player with the card having the highest statistic wins the cards of the other players.

5. A method for playing a competitive card game simulating wrestling matches in accordance with claim 1, wherein the choosing step includes having one of the players choose the category of the statistics to be compared.

6. A method for playing a competitive card game simulating wrestling matches in accordance with claim 5, wherein during the comparing step, if the statistics in the chosen category on the selected cards are the same, then another player chooses another category of the statistics to be compared.

7. A method for playing a competitive card game simulating wrestling matches in accordance with claim 1, wherein the information on each card includes an image of a specific wrestler thereon.

8. A method for playing a competitive card game simulating wrestling matches in accordance with claim 1, wherein said indicia further comprises information selected from the group consisting of one or more wrestling moves of said specific wrestler represented thereon, a rating of punishment that said one or more wrestling moves can inflict on an opponent, a rating of total amount of punishment that said specific wrestler represented thereon can sustain, and any combinations thereof.

9. A method for playing a competitive card game simulating wrestling matches, the method comprising the steps of:

(a) providing a stack of playing cards for each player playing the game, each card representing a specific wrestler and having a plurality of games thereon, wherein said card has indicia thereon representing a ranking of the wrestler;

(b) selecting a ranking comparison game from said plurality of games on said card, said plurality of games comprising a ranking comparison game and a wrestler's match game;

(c) selecting a card from the stack of each player; and (d) comparing the rankings of the wrestlers on the selected cards to determine a winner of the card game.

10. A method for playing a competitive card game simulating wrestling matches in accordance with claim 9, wherein during the comparing step, the rankings of the wrestlers represented on the selected cards are compared and the player with the card having the highest ranking wins the selected cards of the other players.

11. A method for playing a competitive card game simulating wrestling matches in accordance with claim 9, further comprising a step where the players drop the selected cards so as to tumble end over end and land either face up or face down, wherein the comparing step includes comparing the rankings of the wrestlers represented on any of the selected cards which are face up and the player with the card having the highest ranking wins the selected cards of the other players.

12. A method for playing a competitive card game simulating wrestling matches in accordance with claim 9, wherein the information on each card includes an image of a specific wrestler thereon.

13. A method for playing a competitive card game simulating wrestling matches, the method comprising the steps of:

(a) providing a playing card for each player, each card representing a specific wrestler and having indicia thereon, wherein said indicia has one or more wrestling moves of said specific wrestler represented thereon, a rating of punishment that said one or more wrestling moves can inflict on an opponent, and a rating of total amount of punishment that said specific wrestler represented thereon can sustain; and (b) each of the players sequentially selecting a wrestling move to be performed from the card of the player and subtracting the rating of punishment of the selected wrestling move from the rating of total amount of punishment of the card of another player, said sequential selection and said subtraction continuing until one of the players depletes the total amount of punishment of the other player, wherein the sequential selecting step is performed using at least one die.

14. A method for playing a competitive card game simulating wrestling matches in accordance with claim 13, wherein the at least one die is sequentially rolled by the players and the at least one die provides information to pick the wrestling moves and thus the rating of punishment to be subtracted from the ratings of total amount of punishment of the card of the other player.

* * * * *